US010343250B2

(12) United States Patent
Pless et al.

(10) Patent No.: US 10,343,250 B2
(45) Date of Patent: Jul. 9, 2019

(54) CLAPPER STYLE STOP VALVE SPHERICAL WASHER LAPPING TOOL

(71) Applicant: SIEMENS ENERGY, INC., Orlando, FL (US)

(72) Inventors: Maxwell Pless, Pittsburgh, PA (US); Stuart C. Weddle, Independence, MO (US); Richard Sennott, Derry, NH (US)

(73) Assignee: SIEMENS ENERGY, INC., Orlando, FL (US)

( * ) Notice: Subject to any disclaimer, the term of this patent is extended or adjusted under 35 U.S.C. 154(b) by 229 days.

(21) Appl. No.: 15/444,657

(22) Filed: Feb. 28, 2017

(65) Prior Publication Data

US 2018/0243879 A1 Aug. 30, 2018

(51) Int. Cl.

| | |
|---|---|
| ***B24B 15/08*** | (2006.01) |
| ***B24B 15/03*** | (2006.01) |
| ***F01D 17/14*** | (2006.01) |
| ***F01D 25/16*** | (2006.01) |

(52) U.S. Cl.

CPC ..... *B24B 15/03* (2013.01); *B24B 15/08* (2013.01); *F01D 17/145* (2013.01); *F01D 25/162* (2013.01); *F05D 2220/31* (2013.01); *F05D 2230/60* (2013.01); *F05D 2230/90* (2013.01)

(58) Field of Classification Search

CPC ..... B24B 15/03; B24B 15/04; B24B 15/08; F01D 17/145; F01D 25/162; F05D 2220/31; F05D 2230/60; F05D 2230/90

USPC ..... 451/59, 344

See application file for complete search history.

(56) References Cited

U.S. PATENT DOCUMENTS

| | | | | |
|---|---|---|---|---|
| 2,271,331 | A * | 1/1942 | Elliott | B60T 15/04 137/625 |
| 2,617,554 | A * | 11/1952 | Smith | F16J 13/10 220/328 |
| 3,889,569 | A * | 6/1975 | Fanciullo | F16B 33/004 411/369 |
| 4,321,772 | A * | 3/1982 | Ziegel | B24B 37/04 451/259 |
| 2013/0260647 | A1* | 10/2013 | Kosiorek | B24B 1/00 451/28 |
| 2018/0297086 | A1* | 10/2018 | McManaman | B08B 1/04 |

* cited by examiner

*Primary Examiner* — Eileen P Morgan

(57) ABSTRACT

A device and method to aid in lapping a spherical washer to a steam turbine component are provided. The device includes a drive head, the drive head made up of a drive cap and a hollow cylindrical portion projecting from the drive cap. The drive cap abuts a surface of the spherical washer. The cylindrical portion fits within and is concentric to an inner diameter of the spherical washer. The device also includes an expanding gasket including an outer diameter having a contour configured to fit a contour of an inner diameter of the spherical washer and an inner diameter slides onto the cylindrical portion such that the gasket and cylindrical portion are concentric. The drive head attaches to a drive unit which imparts a torque to lap the spherical washer with respect to a steam turbine component. The expanding gasket expands and holds the spherical washer during the lapping.

11 Claims, 5 Drawing Sheets

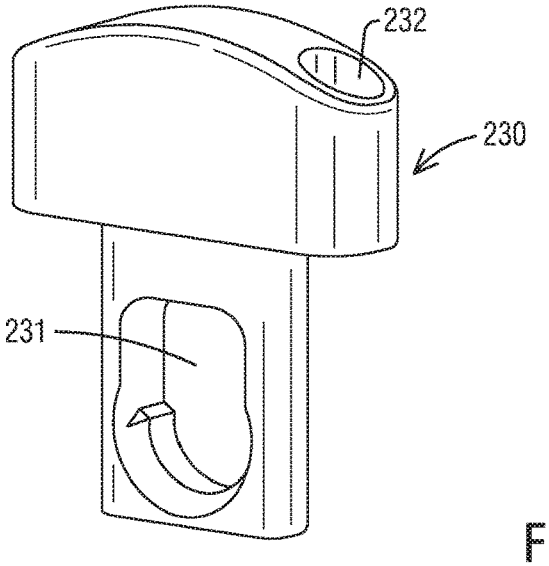
FIG. 5
FIG. 6
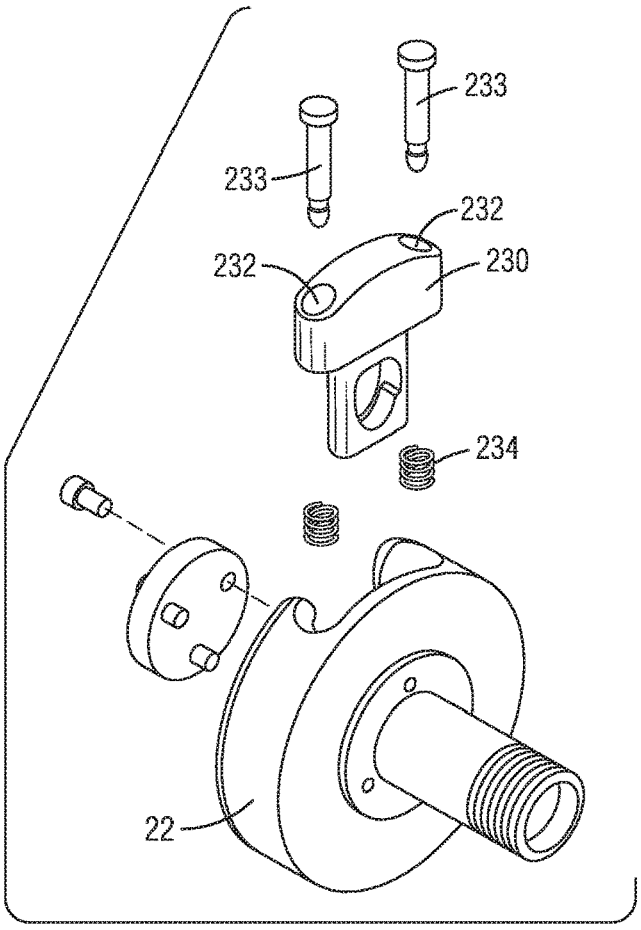

CLAPPER STYLE STOP VALVE SPHERICAL WASHER LAPPING TOOL

BACKGROUND

1. Field

The present disclosure relates generally to a device to aid a lapping process of two components, and more particularly, to a device to aid in lapping a spherical washer to another steam turbine component.

2. Description of the Related Art

A conventional steam turbine includes a higher pressure turbine and at least one lower pressure turbine coupled to a single shaft. Steam enters the turbine at the high pressure turbine through a stop valve and a control valve. The thermal energy of the steam is converted to mechanical energy in the higher pressure turbine, and the steam is exhausted to reheaters. In each reheater, the steam is dried, reheated, and superheated prior to its entry into the lower pressure turbine. The superheated steam is routed through the stop valve as it travels from the reheater to the lower pressure turbine. Energy conversion occurs again in the lower pressure turbine as the steam expands into the vacuum of the main condenser.

A spherical washer is part of the stop valve assembly that seals off the steam and helps to align the steam turbine shaft. In the stop valve assembly, the spherical washer seats against the shaft shoulder on the flat side and against a casing bushing on the spherical side, the casing bushing disposed concentrically with and surrounding the shaft. Each time the stop valve is inspected during periodic maintenance, the stop valve is removed from the steam turbine, and the spherical washer is replaced with a new one. In order to ensure that the spherical washer will seal properly, the new washer is lapped against its mating counterpart, the casing bushing, in the valve casing and the shaft shoulder. Lapping two components is a machining process which involves rubbing the two mating surfaces of the two components together with an abrasive, or lapping compound, between them.

Holding the spherical washer from the inside in order to lap its spherical seat to the spherical mating surface of the casing bushing has proven to be difficult. For example, the spherical washer, in its assembled location within the stop valve, is in a fairly confined area. A field technician working within the valve to lap the spherical washer will find the working space cramped and difficult to maneuver. A variety of methods have been used by field technicians to lap the spherical washer. As an example, a block of wood has been used to hold the spherical washer by its inner diameter and rotated by hand as the technician manually applies the lapping compound onto the outer diameter surface of the spherical washer. The drawback to this approach is that it very labor intensive.

Consequently, a tool that allows a technician to firmly hold the spherical washer while the washer is being lapped to the casing bushing within the reheat valve assembly is desired.

SUMMARY

Briefly described, aspects of the present disclosure relates to a device to aid in lapping a spherical washer to a steam turbine component and a method to lap a first turbine component to a second turbine component.

A device to aid in lapping a spherical washer to a steam turbine component is provided. The device includes a drive head, the drive head made up of a drive cap and a hollow cylindrical portion projecting from the drive cap. The drive cap is configured to abut a surface of the spherical washer. The cylindrical portion fits within and is concentric to an inner diameter of the spherical washer. The device also includes an expanding gasket, the expanding gasket including an outer diameter having a contour configured to fit a contour of an inner diameter of the spherical washer and an inner diameter slides onto the cylindrical portion such that the gasket and cylindrical portion are concentric. The drive head is configured to attach to a drive unit which may impart a torque sufficient to lap the spherical washer with respect to a steam turbine component. The expanding gasket expands and holds the spherical washer during the lapping.

A method to lap a first turbine component to a second turbine component is provided. A lapping compound is applied to an outer surface of the first turbine component. The device as described above is prepared for the lapping of the first component to the second component by positioning the device including the first component against the second turbine component such that the outer surface of the first turbine component abuts an inner surface of the second turbine component. A drive unit may then be attached to the drive head. A torque is imparted by the drive unit to the device sufficient to lap the first turbine component to the second turbine component.

BRIEF DESCRIPTION OF THE DRAWINGS

FIG. 5 illustrates a perspective view of a latching mechanism, FIG. 6 illustrates an exploded view of the latching mechanism and the drive cap.

DETAILED DESCRIPTION

To facilitate an understanding of embodiments, principles, and features of the present disclosure, they are explained hereinafter with reference to implementation in illustrative embodiments. Embodiments of the present disclosure, however, are not limited to use in the described systems or methods.

The components and materials described hereinafter as making up the various embodiments are intended to be illustrative and not restrictive. Many suitable components and materials that would perform the same or a similar function as the materials described herein are intended to be embraced within the scope of embodiments of the present disclosure.

Figure 1:
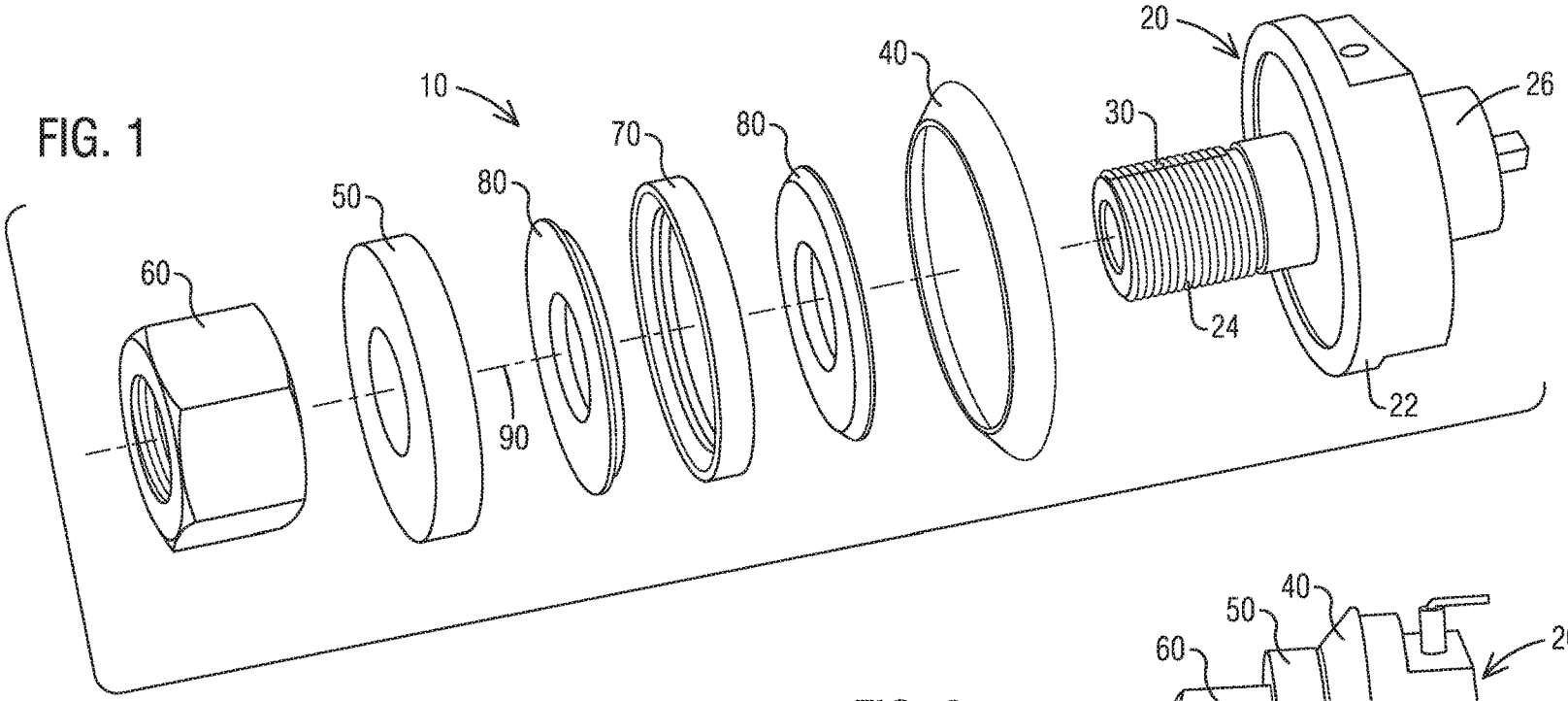
FIG. 1 illustrates an exploded view of a device to aid in lapping a spherical washer to a steam turbine component.

Referring now to the figures, where the showings are for purposes of illustrating embodiments of the subject matter herein only and not for limiting the same, FIG. 1 illustrates an exploded view of a device 10 to aid in lapping a spherical washer 40 to another steam turbine component. The device 10 includes a drive head 20 which may be configured to attach to a drive unit in order to impart a torque sufficient to lap the two steam turbine components with respect to one another. Those skilled in the art would understand that the disclosed device may be employed in many other industrial systems as well as the embodiment including a steam turbine engine as discussed, for exemplary purposes, below.

As discussed above, a device 10 to aid in lapping a spherical washer 40 to another steam turbine component is desired. The proposed device 10, shown in FIG. 1, includes a drive head 20, the drive head 20 including a drive cap 22 and a hollow cylindrical portion 30 projecting from the drive cap 22. The cylindrical portion 30 may include threads 24 for securely attaching components onto the cylindrical portion 30.

Figure 2:
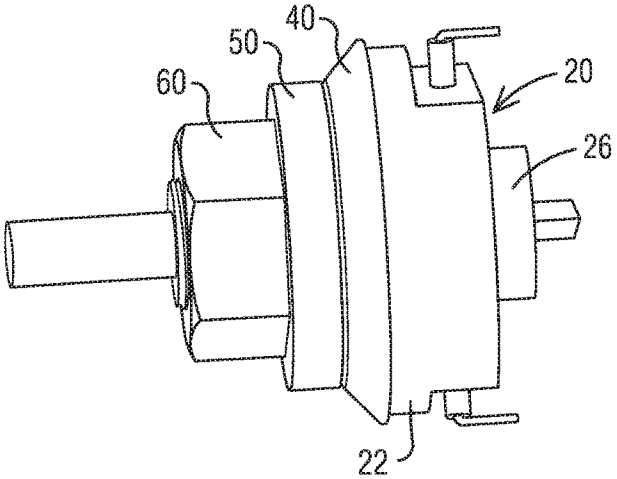
FIG. 2 illustrates a perspective view of the device secured to a spherical washer.

A spherical washer 40 secured to the device 10 is illustrated in FIG. 2. The drive cap 20 is configured to abut the spherical washer 40. The cylindrical portion 30 fits within and is concentric to the inner diameter of the spherical washer 40. A fastener 60 may be used to secure the spherical washer 40 to the drive cap 22. A first alignment device 50, embodied in FIG. 2 as a bushing, may be used to properly align the device 10 and the spherical washer 40 with the steam turbine component. A driver portion 26 of the drive cap 22 opposite the projecting cylindrical portion 30 is configured to attach to a drive unit. The drive unit may impart a torque sufficient to lap the spherical washer 40 with respect to the steam turbine component.

Figure 4:
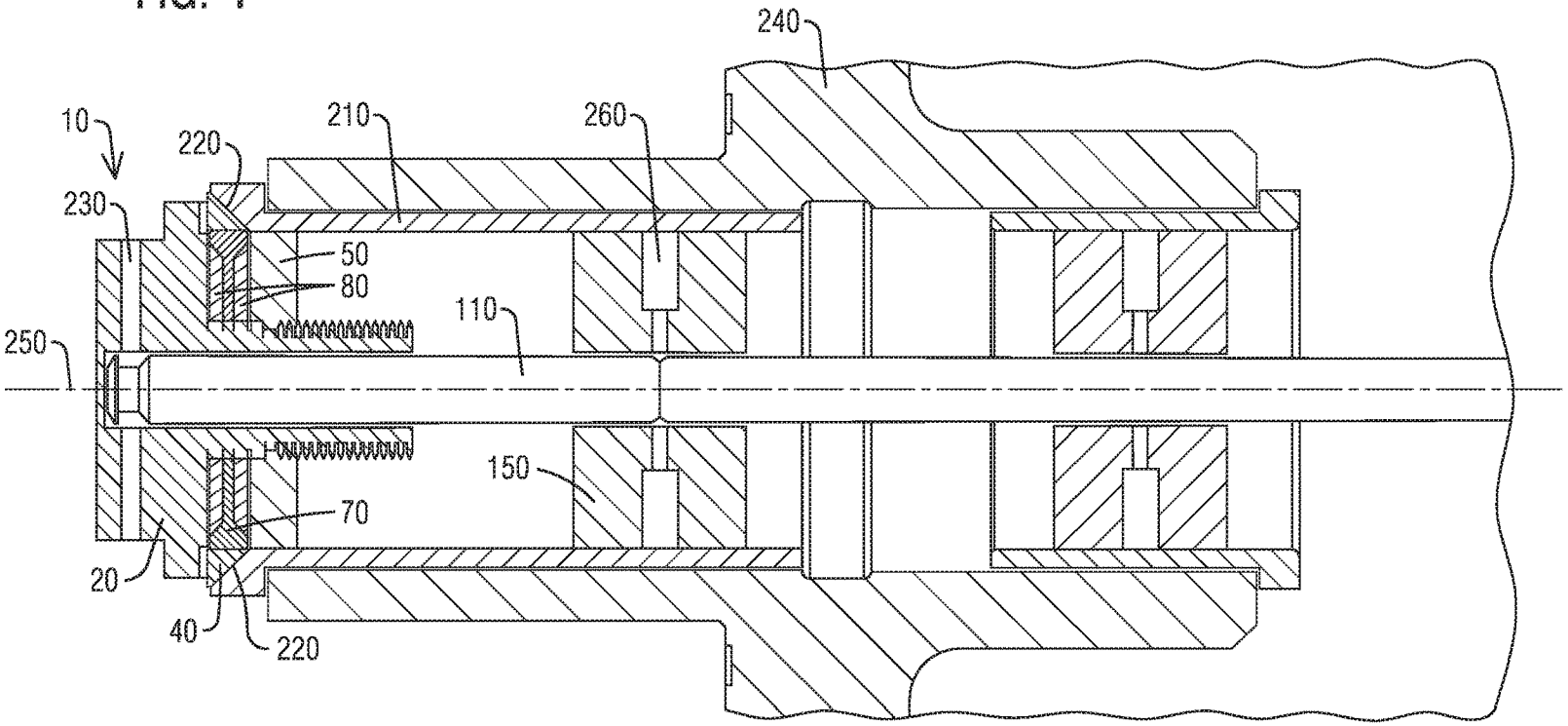
FIG. 4 illustrates a cross sectional view of the device secured within the valve casing.

In the embodiment described below, the steam turbine component is a stop valve casing bushing 210. A cross section of the casing bushing 210 within a steam turbine stop valve casing 240 may be seen in FIG. 4. The outer diameter of the spherical washer 40 may include a spherical contour that matches a corresponding spherical contour of the casing bushing 210. In the steam turbine, the casing bushing 210 abuts the stop valve casing 240 on its outer diameter and the steam turbine shaft on its inner diameter. The spherical contour of the casing bushing 210 may be an end surface 220 as seen in the embodiment of FIG. 4.

Referring back to FIG. 1, the device 10 may also include an expanding gasket system, including an expanding gasket 70 and two plates 80, one each disposed on opposite sides of the gasket 70 with respect to a longitudinal shaft axis 90. The outer diameter of the gasket 70 is configured to conform to a contour of the inner diameter of the spherical washer 40. The inner diameter of the gasket 70 may be tapered internally from both sides of the gasket such that a cross section of the gasket includes a V shape. The angle of incline for each taper on the inner diameter of the gasket 70 may be in the range of 45 to 60 degrees with respect to the longitudinal shaft axis 90. The expanding gasket 70 may comprise a rubber material such as a polyurethane material.

The two plates 80, a first plate and a second plate, one each disposed on opposite sides of the gasket 70 may be used to expand the gasket 70 when the two plates 80 are axially compressed towards one another into the inner diameter of the gasket 70. Each of the two plates 80 may be tapered internally on an outer diameter such that the contour of each taper conforms to the inner diameter taper of the gasket 70. When compressed together the tapers of the two plates 80 may abut and conform to the inner diameter taper of the gasket 70. In this way, the compression of the two plates 80 may be used to expand the gasket 70 and grip the spherical washer 40 without deforming the spherical washer 40. A deformed spherical washer could not be correctly lapped to its mating counterpart necessitating a replacement for the part and resulting in lost time and perhaps a longer shutdown time for the steam turbine.

FIG. 1 also illustrates the position of the gasket 70 and the two plates 80 with respect to the drive head 20 and the longitudinal shaft axis 90. The gasket 70 and the two plates 80 are configured to slide over the cylindrical portion 30 of the drive head 20 as well as to be concentric with the cylindrical portion 30. The first plate 80 may be disposed axially inward with respect to the drive head 20 and the second plate 80 may be disposed axially outward with respect to the drive head 20. The two plates 80 are free to slide axially along the cylindrical portion 30. When the fastener 60 is fastened, by perhaps screwing the fastener onto the threads of the cylindrical portion, the alignment device 50 pushes the plates axially together, expanding the gasket 70 and securing the gasket system 70, 80 to the drive cap 22.

A first alignment device 50, illustrated in FIG. 1, may also be configured to slide over the outer diameter of the cylindrical portion 30 of the drive head 20 and fit within the casing bushing 210 of the steam valve casing 240. The first alignment device 50 may be disposed adjacent to and axially outward from the second plate, with respect to the drive head 20. The first alignment device 50 may align the device 10 to be concentric with the casing bushing 210. Additionally, the alignment device 50 may act as a compression spacer for the expanding gasket 70 and the two plates 80 by providing an axial compression to the expanding gasket 70.

Figure 3:
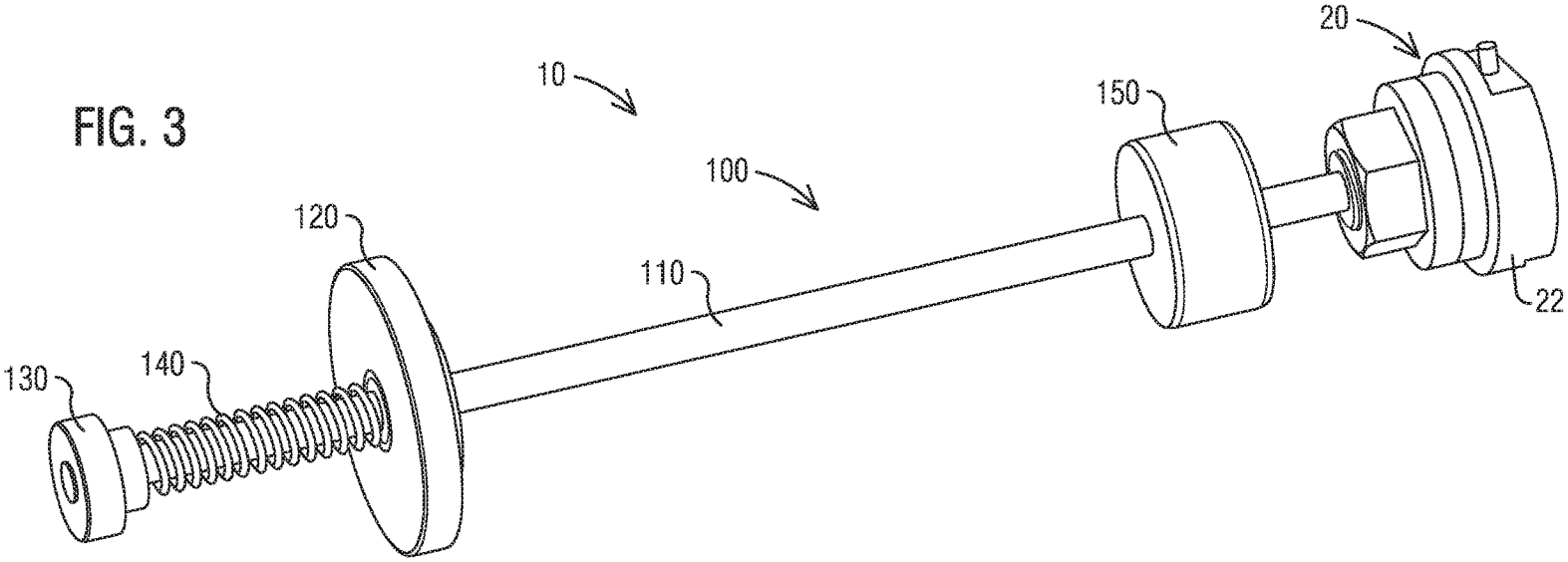
FIG. 3 illustrates a perspective view of the device including a tension bar assembly.

Referring now to FIG. 3, an embodiment of the device 10 is illustrated in which the device 10 further includes a tension bar assembly 100. The tension bar assembly 100 is configured to apply a constant and consistent force during the lapping of the spherical washer 40 to the steam turbine component by thrusting the spherical washer 40 against the steam turbine component, which in the exemplary embodiment the steam turbine component is the casing bushing 210.

The tension bar assembly 100 includes a tension shaft 110, which may be embodied as a cylindrical shaft. A first end of the tension shaft 110 fits within the cylindrical portion 30 of the drive head 20 and extends into the drive cap 22 where it is secured. The tension bar assembly 100 may also include a stop plate 120. The stop plate 120 is configured to abut a surface of a further steam turbine component so that a constant and consistent tension may be provided to the spherical washer 40 and the end surface 220, as seen in FIG. 4, of the casing bushing 210 while they are being lapped with respect to one another. A stop plate 120 abutting the surface of a support yoke 410 of the stop valve 400 may be seen in FIG. 8.

The tension bar assembly 100 may also include a compression knob 130 disposed at a second end of the tension shaft 110 opposite the first end. Both the compression knob 130 and the stop plate 120 may include a central hole such that an inner diameter of the compression knob 130 and stop plate 120 may be disposed onto the tension shaft 110 and positioned concentric to the tension shaft 110. The stop plate 120 and the compression knob 130 may be connected by a spring 140 so that the stop plate 120 may easily move relative to the tension shaft 110 and position the stop plate 120 so that it abuts the surface of the further steam turbine component. A tightening adjustment of the compression knob 130 compresses the spring 140 against the stop plate 120 which then induces a constant axial tension along the device 10 pulling the drive head 20 including the spherical washer 40 against the end surface 220 of the casing bushing 210. In this way, controlling the compression knob 130 enacts a constant controllable force between the spherical washer 40 against its mating component 220.

The tension bar assembly 100 may also include a second alignment device 150 having an inner diameter disposed onto the outer diameter of tension shaft 110 and an outer diameter abutting the inner diameter of the casing bushing 210. The second alignment device 150 allows the spherical washer 40 to be reliably lapped concentric to the end surface 220 of casing bushing 210. In the shown embodiment of FIG. 3, the second alignment device 150 is a tension bushing.

Referring back to FIG. 4, a cross sectional view of the device 10 secured to the spherical washer 40 is illustrated. Additionally, the device 10 is shown holding the spherical washer 40 against the casing bushing 210. In this configuration, the spherical washer 40 may be firmly held and aligned with the stop valve shaft axis 250 within stop valve casing 240 so that it may be lapped to the casing bushing 210. The end surface 220 of the casing bushing 210 may include a spherical surface 220. The spherical washer 40 includes a corresponding spherical surface that abuts the spherical surface of the casing bushing 210. A lapping process of the two surfaces allows the two surfaces to lie flush against one another so that a proper seal is formed between the two components 40, 210 such that steam will not leak out of the stop valve 400.

In the embodiment shown in FIG. 4, the first end of the tension shaft 110 of the tension bar assembly 100 is shown secured to the drive cap 22 using a latching mechanism 230. The latching mechanism 230 catches and holds the tension bar assembly 100.

The latching mechanism 230 comprises a catch piece as shown in FIGS. 5 and 6. FIG. 6 illustrates an exploded view of the catch piece and the drive cap 22 and indicates how the catch piece 230 may be installed into the drive cap 22. In this embodiment, the catch piece 230 slides down within an interior portion of the drive cap 22 and includes an opening 231 into which the first end of the tension shaft 110 may be inserted. Thus, the catch piece 230 catches and securely holds the first end of the tension shaft 110. Conversely, in order to release the first end of the tension shaft 110, the catch piece 230 may be depressed at its top surface, which lies flush with the top surface of the drive cap 22. Into the top surface of the catch piece 230, at least one through hole 232 is disposed into which a fastener 233 and a spring 234 may be inserted. The fasteners 233 secure the catch piece to the drive cap 22. The spring 234 enables the releasing functionality of the catch piece 230. Using the latching mechanism of the drive head 20 enables a quick latching/unlatching of the drive head 20 to/from the tension shaft assembly 100.

In the illustrated embodiment of FIG. 4, the two plates 80 are shown compressing the expanding gasket 70 such that the outer diameter of the gasket 70 abuts the inner diameter of the spherical washer 40 gripping the spherical washer 40 and radially holding it against the spherical end surface 220 of the casing bushing 210. The first alignment device 50, shown as a bushing in the illustrated embodiment, assists in compressing the expanding gasket system 70, 80. Additionally, the first alignment device 50 helps guide the expanding gasket 70 near the lapping area. A fastener, such as a nut, may be threaded onto threads of the cylindrical portion 30 securing the alignment device 50, the gasket 70 and two plates 80 to the drive head 20. A second alignment device 150 comprising a tension shaft bushing 150 is shown within and concentric to the casing bushing 210. The tension shaft bushing 150 slides onto the tension shaft 110 and helps the device 10 and the spherical washer 40 to maintain concentricity with the casing bushing 210. Maintaining concentricity between spherical washer 40 and the casing bushing 210 promotes a successful lapping of the two components and reduces the time the technician spends on the lapping process. If the components are not properly lapped to one another, one may need to re-lap the components leading to lost time and perhaps more downtime for the steam turbine engine.

The tension shaft bushing 150 may be locked into the tension shaft 110 of the tension bar assembly 100 using a locking mechanism. The locking mechanism may be embodied as a spring plunger. A spring plunger 260 may be used within each tension shaft bushing 150 to lock the tension shaft bushing 150 to the tension shaft 110. The spring plunger 260 may include a conical tip which fits a matching groove in the tension shaft 110 locking the tension shaft bushing 150 into the tension shaft 110. A break away force may be controlled by how much the spring plunger 260 is threaded into the tension shaft bushing 150. The spring plungers 260 may be radially threaded into the tension shaft 110. Thus, to install the tension bushings 150 onto the tension shaft 110, one may slide a tension shaft bushing 150 onto the tension shaft 110 and locate it onto a designated position using the locking mechanism. Multiple spring plungers 260 may be used and evenly spaced around the circumference of the bushing 150 in order to more securely lock the tension bushing 150 onto the tension shaft 110. For example, three spring plungers 260 may be spaced 120 degrees apart around the circumference of the tension bushing 150.

Figure 7:
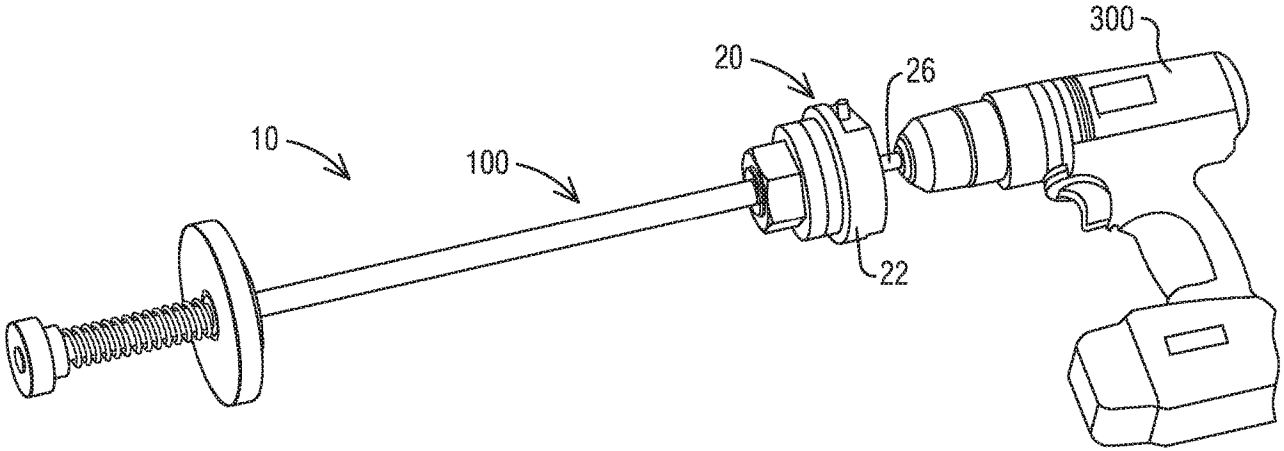
FIG. 7 illustrates a perspective view of the device including a tension bar assembly attached to a drill.
Figure 8:
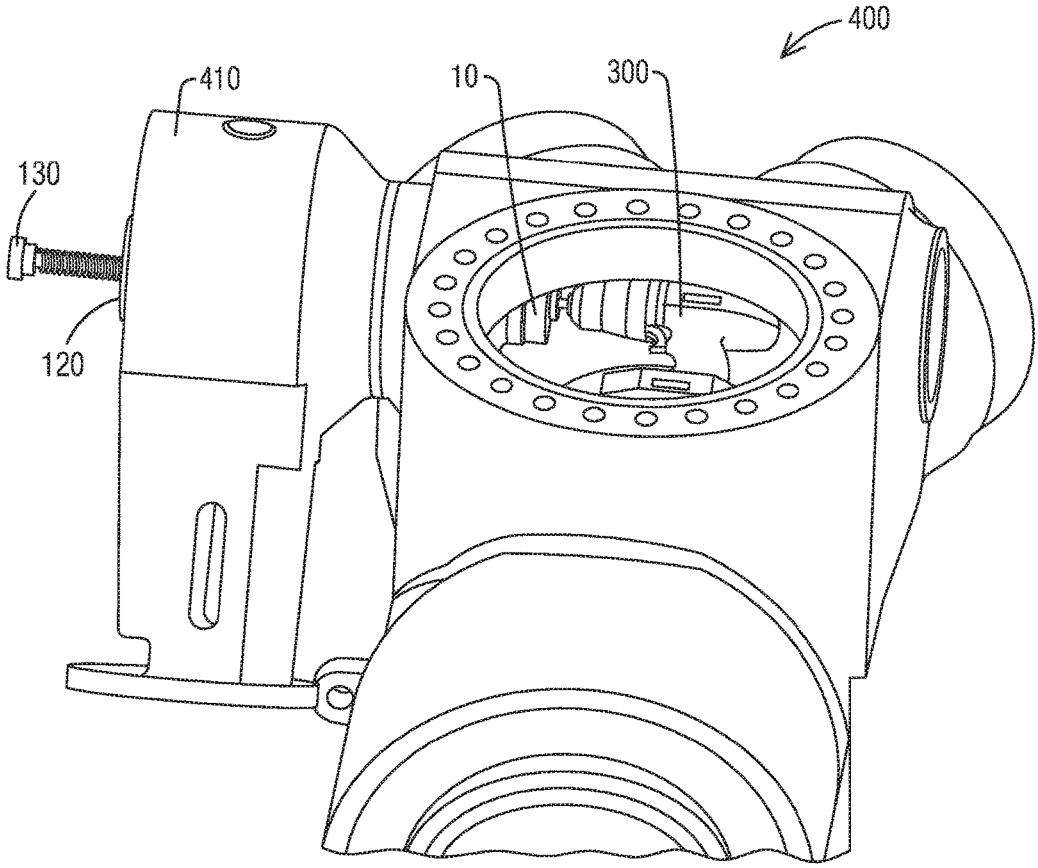
FIG. 8 illustrates a perspective view of the device within a clapper style stop valve.

Referring now to FIG. 7, a perspective view of the device 10 including the tension bar assembly 100 is shown attached to a drive unit 300. In the embodiment of FIG. 8, the drive unit 300 is a drill. As described above the drive unit 300 imparts a torque to the device 10 that may be sufficient to lap the first turbine component to a second turbine component. The drive head 20 may include a driver portion 26 disposed at one end of the drive head 20 and configured to attach to the drive head 20. The driver portion 26 may include a hexagonal projection that will mate with a drill bit, for example, of the drive unit 300.

For illustrative purposes, FIG. 8 shows a perspective view of the device 10 within a clapper style stop valve 400 attached to the drill. From FIG. 8, one skilled in the art can see the scale of the device 10 and drill 300 within the stop valve 400 and the space constraints a technician may encounter when working within the stop valve 400 to lap the spherical washer 40 to the stop valve casing bushing 210.

Referring to FIGS. 1-8, a method to lap a first turbine component 40 to a second turbine component 210 is also provided. The method includes applying a lapping compound to an outer surface of the first turbine component 40. According to the method, a technician may then prepare the device 10, as described above, for a lapping procedure of the first turbine component 40 to the second turbine component 210 by positioning the expanding gasket system 70, 80 over the cylindrical portion 30 of the drive head 20. Additionally, an inner diameter of the first turbine component 40 may be positioned over the outer diameter of the cylindrical portion 30 adjacent to the gasket 70. Once the gasket system 70, 80 and the first turbine component 40 are secured onto the cylindrical portion 30 of the drive head 20, the device 10 including the first turbine component 40 may be positioned against the second turbine component 210 such that the outer surface of the first component 40 abuts and inner surface of the second turbine component 210. A drive unit 300 may then be attached to a driver portion 26 of the drive head 20.

The lapping procedure commences when the drive unit 300 imparts a torque to the device 10 sufficient to lap the first turbine component 40 to the second turbine component 210. During the lapping procedure, the first turbine component 40 rotates with respect to a stationary second component 210 lapping the first component 40 to the second component 210. The lapping procedure may be accomplished in less than 4 hours, a significant improvement from the 4 to 12 hours that the conventional procedures have taken.

In an embodiment, preparing the device 10 includes attaching a tension bar assembly 100, as described above, to the drive head 20. The tension bar assembly 100 applies a constant and consistent axial force during the lapping procedure of the first turbine component 40 to the second turbine component 210 by thrusting the first turbine component 40 against the second turbine component 210. The tension bar 110 is attached to the drive head 20 by inserting a first end of the tension shaft 110 into the hollow cylindrical portion 30 of the drive head 20. The device 10 is secured within the drive cap 22 by latching the first end with a latching mechanism 230 within the interior of the drive cap 22.

As described above, in order for the lapping procedure to be successful such that a proper seal may be formed between the two components 40, 210, the method may include aligning the first turbine component 40 to be concentric with the second turbine component 210. The aligning may be accomplished by positioning a tension bushing 50 over the outer diameter of the cylindrical portion 30 of the drive head 20. An inner diameter of the tension bushing 50 slides over the outer diameter of the cylindrical portion 30. The tension bushing 50 may align the device 10 and the first component 40 to be concentric with the second component 210.

In the described embodiment of the method, the first component is a spherical washer 40 and the second component is a casing bushing 210 of a stop valve assembly 240 in a steam turbine engine, however, one skilled in the art of turbomachinery would understand that other industrial components may be lapped to one another using the proposed device and method.

The disclosed device and method to lap a first turbine component to a second turbine component accomplishes the objective of firmly holding the spherical washer in order to lap it to the casing bushing within the stop valve assembly. By providing an alignment device, the tool may also align the device including the spherical washer with the casing bushing so that the lapping procedure produces good results. Additionally, using the provided tool reduces the time to lap the spherical washer to casing bushing at least by half and makes the lapping procedure less physically challenging for the technicians performing the procedure.

While embodiments of the present disclosure have been disclosed in exemplary forms, it will be apparent to those skilled in the art that many modifications, additions, and deletions can be made therein without departing from the spirit and scope of the invention and its equivalents, as set forth in the following claims.

What is claimed is:

1. A device to aid in lapping a spherical washer to a steam turbine component, comprising:

a drive head comprising a drive cap and a hollow cylindrical portion projecting from the drive cap, the drive cap configured to abut a surface of the spherical washer, the cylindrical portion fitting within and concentric to an inner diameter of the spherical washer, an expanding gasket including an outer diameter having a contour configured to fit a contour of an inner diameter of the spherical washer, an inner diameter of the gasket sliding onto the cylindrical portion such that the gasket and cylindrical portion are concentric, wherein the drive head is configured to attach to a drive unit, the drive unit imparting a torque sufficient to lap the spherical washer with respect to a steam turbine component, and wherein the expanding gasket expands and holds the spherical washer during the lapping.

2. The device as claimed in claim 1, further comprising:

the expanding gasket tapered internally from each side on an inner diameter, and two plates, a first plate and a second plate, each tapered internally on an outer diameter such that the contour of each taper conforms to a taper of the gasket, the two plates disposed on opposite sides of the gasket with respect to a shaft axis, wherein the inner diameter of the expanding gasket and the inner diameters of the two plates slide over and are concentric with the cylindrical portion, wherein the first plate is disposed axially inward with respect to the drive head 20, and the second plate is disposed axially outward with respect to the drive head, wherein when the two plates are axially compressed towards one another such that the tapers of each plate abut the taper of the gasket, the gasket expands and grips the spherical washer without deformation.

3. The device as claimed in claim 2, further comprising a tension bar assembly configured to apply a constant and consistent axial force during the lapping of the spherical washer to the steam turbine component by thrusting the spherical washer against the steam turbine component.

4. The device as claimed in claim 3, wherein the tension bar assembly comprises a tension shaft, a first end of the tension shaft fitting within the hollow cylindrical portion of the drive head and extending into the drive cap where the first end is secured.

5. The device as claimed in claim 4, wherein the drive cap includes a latching mechanism for catching and holding the tension bar assembly, wherein the latching mechanism slides down within the interior portion of drive cap and includes an opening to allow the first end of the shaft to slide within the latching mechanism and the drive cap.

6. The device 10 as claimed in claim 4, wherein the tension bar assembly further comprises a stop plate and a compression knob, both the stop plate and the compression knob concentric to the tension shaft, wherein a surface of the stop plate abuts an outer surface of a stop valve assembly holding the tension bar assembly in place, and wherein a tightening adjustment of the compression knob compresses a spring against the stop plate which then induces a constant axial tension along the device, the spring connecting the compression knob with the stop plate.

7. The device as claimed in claim 2, further comprising a first alignment device sliding onto the outer diameter of the cylindrical portion of the drive head and abutting the second plate, wherein the alignment device aligns the device to be concentric with the steam turbine component.

8. The device as claimed in claim 6, further comprising a second alignment device aligning the device to be concentric with the steam turbine component.

9. The device 10 as claimed in claim 8, wherein the second alignment device is a tension shaft bushing, wherein an inner diameter of the tension shaft bushing fits the outer diameter of the tension shaft.

10. The device 10 as claimed in claim 9, wherein the tension shaft bushing locks into the tension shaft using a locking mechanism, and wherein the locking mechanism comprises a spring plunger including a conical tip, the conical tip fitting into a matching groove in the tension shaft locking the alignment device into the tension shaft using a spring force.

11. The device as claimed in claim 1, wherein the second turbine component is a stop valve casing bushing.

* * * * *